US007600352B2

(12) United States Patent
Schulze

(10) Patent No.: US 7,600,352 B2
(45) Date of Patent: Oct. 13, 2009

(54) SLAB SAVER FORM ATTACHMENT DEVICE

(76) Inventor: Todd M. Schulze, P.O. Box 4252, Mooresville, NC (US) 28117

( * ) Notice: Subject to any disclaimer, the term of this patent is extended or adjusted under 35 U.S.C. 154(b) by 15 days.

(21) Appl. No.: 11/877,864

(22) Filed: Oct. 24, 2007

(65) Prior Publication Data

US 2009/0107058 A1 Apr. 30, 2009

(51) Int. Cl.
*E04C 5/00* (2006.01)

(52) U.S. Cl. ..... 52/256; 52/287.1; 52/699; 52/716.1; 249/91; 264/275

(58) Field of Classification Search ..... 52/716.1, 52/718.01, 717.05, 254, 255, 256, 287.1, 52/288.1, 273, 601, 745.2, 745.11, 699, 700, 52/800.11; 249/96, 97, 91; 264/271.1, 274, 264/275; 248/48.1, 48.2, 71, 74.2, 231.91, 248/234, 235, 250, 251

See application file for complete search history.

(56) References Cited

U.S. PATENT DOCUMENTS

| | | | | | |
|---|---|---|---|---|---|
| 704,957 | A * | 7/1902 | Croom | 248/235 |
| 760,999 | A * | 5/1904 | Landis | 404/8 |
| 857,775 | A * | 6/1907 | Walter | 404/8 |
| 875,025 | A * | 12/1907 | Whinery | 404/8 |
| 1,209,713 | A * | 12/1916 | Kane | 404/8 |
| 1,561,126 | A * | 11/1925 | Timm | 52/254 |
| 2,705,820 | A * | 4/1955 | Torrence | 52/782.2 |
| 3,138,834 | A * | 6/1964 | Shanok et al. | 428/120 |
| 3,273,296 | A * | 9/1966 | Soulon | 52/288.1 |
| 3,286,422 | A * | 11/1966 | Pangerl | 52/288.1 |
| 3,669,395 | A * | 6/1972 | Gehrke | 248/235 |
| 4,150,517 | A * | 4/1979 | Warner, Sr. | 52/288.1 |
| 4,315,390 | A * | 2/1982 | Schaafsma | 52/287.1 |
| 4,320,614 | A * | 3/1982 | Brezosky | 52/630 |
| 4,760,681 | A * | 8/1988 | Harrison | 52/716.2 |
| 4,897,973 | A * | 2/1990 | Foster et al. | 52/102 |
| 4,903,920 | A * | 2/1990 | Merritt | 248/71 |
| 5,064,158 | A * | 11/1991 | Brazier et al. | 248/250 |
| 5,168,682 | A * | 12/1992 | Rye | 52/309.17 |
| 5,664,376 | A * | 9/1997 | Wilson et al. | 52/287.1 |
| 5,829,213 | A | 11/1998 | Schulze et al. | |
| 6,030,144 | A * | 2/2000 | Cannella | 404/7 |
| 6,073,891 | A * | 6/2000 | Humber | 248/74.5 |
| 6,364,262 | B1 * | 4/2002 | Gibson et al. | 248/229.14 |

(Continued)

FOREIGN PATENT DOCUMENTS

GB 2087968 A * 6/1982

*Primary Examiner*—Brian E Glessner
(74) *Attorney, Agent, or Firm*—Dennis G. LaPointe

(57) ABSTRACT

A concrete poured wall corner slab saver and form attachment device that includes a slab saver corner piece having two sides with an inwardly directed central stem portion, and a form attachment device which is a generally shaped triangular form configured to be inserted between one side of corner piece and the stem portion of the corner piece. The form attachment device further a longitudinal aperture near an upper edge that extends through the attachment device with an aperture therein sized to insert a nail for engaging the combined slab saver corner piece and form attachment device to a form board, The attachment device has a generally C-shaped slotted portion forming a slotted aperture configured to engage the expanded portion of the stem of the corner piece and a hollowed core portion to more fully encase the device within the poured concrete.

6 Claims, 3 Drawing Sheets

U.S. PATENT DOCUMENTS

D504,589 S * 5/2005 Sudano ..... D6/580
D552,269 S * 10/2007 Vibiano et al. ..... D25/164
7,392,627 B2 * 7/2008 Sondermann ..... 52/464
7,409,802 B2 * 8/2008 Fiedler ..... 52/466
2006/0272269 A1 * 12/2006 Bannister ..... 52/718.01
2008/0092470 A1 * 4/2008 Jackson ..... 52/288.1
2009/0000236 A1 * 1/2009 Schlumpf ..... 52/699
2009/0077915 A1 * 3/2009 Haga ..... 52/288.1

* cited by examiner

SLAB SAVER FORM ATTACHMENT DEVICE

FIELD OF THE INVENTION

The present invention relates to a device for facilitating the installation of a corner slab saver for use as a pre-cast panel insert used to protect the surrounding areas, particularly the floors, while the pre-cast walls are being placed during tilt/wall construction.

DESCRIPTION OF THE PRIOR ART

During the construction and erection of concrete buildings by use of the method commonly referred to as "Tilt/Wall Construction", the movement of the wall units across the existing concrete floors for placement as building walls usually causes extensive damage to the building's concrete floor when the walls are moved and erected into place.

Typically, when tilt/wall construction is employed, each concrete wall is formed and poured on top of the building's concrete slab floor. After the wall has hardened, it is moved (i.e., tilted and slid along the floor) to its designated location. The sliding process generally results in significant scaring and damage to the concrete floor caused by the lower outside corner of the wall contacting the concrete floor. The resultant damage to the concrete floor must then be repaired at the expense of additional time, labor, materials, and associated costs.

One such slab saver device is that disclosed in U.S. Pat. No. 5,829,213, issued on Nov. 3, 1998 to Schulze et al., which is herein incorporated by reference.

The object of the present invention is to provide a device that significantly makes it easier to install the slab saver pieces, generally two or three segments along a wall edge, to the adjacent form board.

SUMMARY OF THE INVENTION

The present invention comprises a slab saver form attachment device. The slab saver is imbedded into the bottom outside corner of a concrete wall when the wall is formed and the attachment device is used to attach the slab saver to an adjacent board used as a form. The attachment device attaches to the stem of the slab saver and extends to one side of the slab saver with an aperture along the top edge of the attachment device through which a fastener, such as a nail, is inserted for nailing to the board. The nail and its aperture are lined up generally perpendicular to side of the slab saver and above the side of the slab saver for direct nailing into the board. In a preferred embodiment, the attachment device has a hollow cored central area through which poured concrete can flow. When the new device is attached, it gives the slab saver more embodiment in the concrete making it stronger and less likely to pull out of the concrete. The attachment device could be made out of any material including, but not limited to, a synthetic resin material, a polypropylene material, a nylon material, a composite of a polymeric material or combinations of these materials, metal, iron, aluminum, etc., as all of it is embedded in the concrete and not exposed. Typically, an 8 penny nail is driven and bent over. During the bending it usually breaks the slab saver. When concrete is finished and hard there is no way to pull prior art device nails from the concrete. If the material on the attachment device is made soft enough and/or the head is small enough (small finish nail type of head), a construction worker is able to pull the nail completely out after casting the concrete.

As mentioned above, one reason for the hollow central core of the attachment device is for allowing the concrete to completely encase the attachment device, the other is less material for manufacturing.

Subsequently, when the wall is lifted, tilted, and slid along the floor to its designated location, the slab saver is the only portion of the wall that comes in contact with the floor. The slab saver, because it is composed of a material that is softer than the concrete, protects the floor from damage. The board can then be removed and any portion of exposed nail can be snipped off or pulled out.

BRIEF DESCRIPTION OF THE DRAWINGS

In the accompanying drawings.

DETAILED DESCRIPTION OF THE INVENTION

Figure 3:
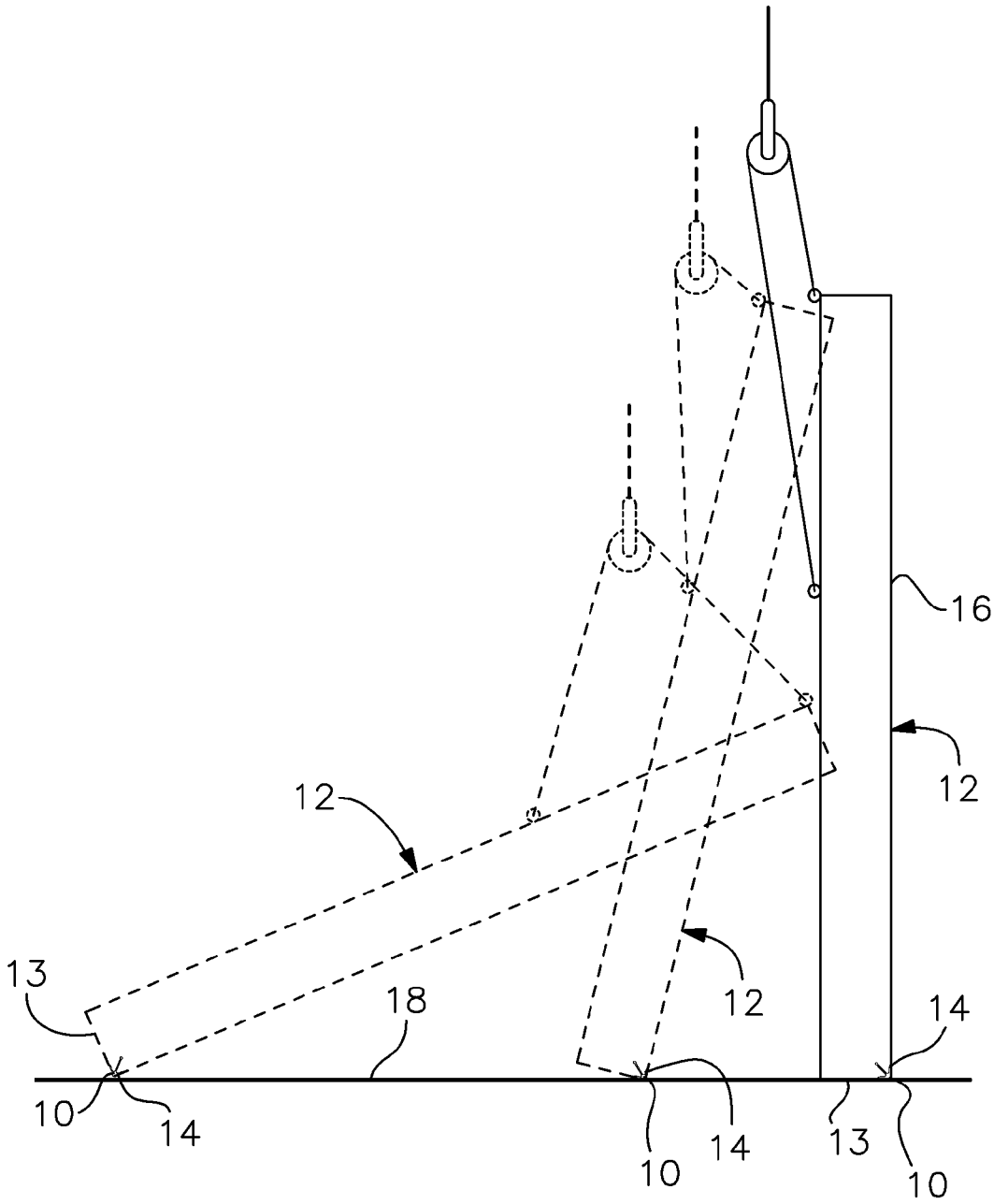
FIG. 3 is an end view conceptually depicting how a slab saver is incorporated into tilt/wall construction illustrating the process of lifting, tilting, and sliding the wall on the floor to its designated location.

In an effort to first describe the slab saver corner pieces, a slab saver 10 is typically used in 2-3 foot long segments along a corner 14 of a proposed concrete wall 12 to be poured. As shown in FIG. 3, it can be seen that the bottom outside corner 14 is in relation to the outside of the building, generally 16, when the wall 12 has been erected and FIG. 3 illustrates the placement and location of the slab saver 10 within the concrete wall 12.

The slab saver 10 may be constructed of any material that exhibits the following characteristics: (1) is strong enough to withstand the weight of the concrete wall 12, in which the slab saver is inserted, without breaking when the wall 12 is tilted and slid into place; and (2) is softer than concrete, such that the slab saver 10 will not scratch, dent, or otherwise mar the surface of the concrete floor 18 when the corner 14 of the wall 12 is dragged along the floor 18 as the wall 12 is slid into place. When the concrete is cured, the wall 12 can be lifted, tilted, and slid on the slab saver 10 without damaging the floor. The slab saver 10 also acts as a permanent outside corner edge for the bottom 13 of the wall 12 once the wall 12 is positioned in its designated location.

Figure 1:
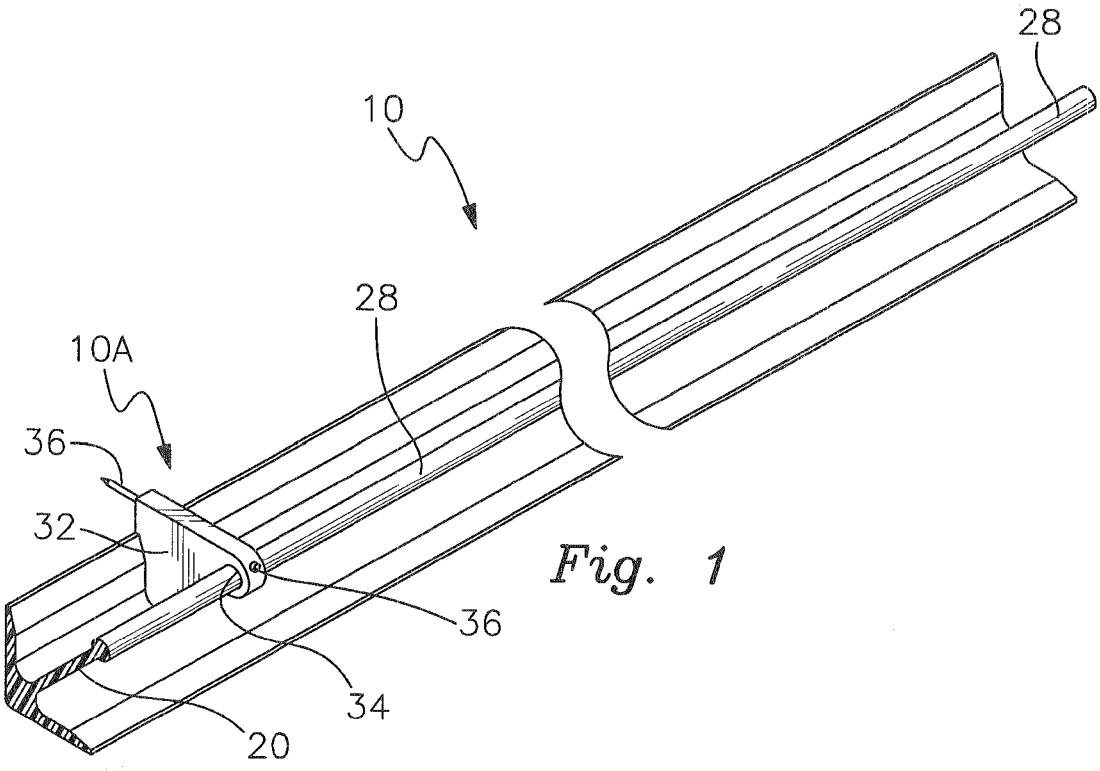
FIG. 1 is a conceptual exploded view of an example of the slab saver attachment device in relation to the slab saver itself.

The shape of a preferred embodiment of the slab saver 10 is illustrated in FIG. 1, where it comprises a longitudinal member 20 that has a first side 22, a second side 24 and a generally central projection or stem 30. When view upside down, the slab saver 10 appears to be "T-shaped" with the upper part of the "T" being "roof-shaped" and forming respective sides 22 and 24. At an upper end of the stem portion 30 is an expanded portion 28 of the stem portion 30. This portion 28 can be T-shaped as well, such as illustrated in the drawings of U.S. Pat. No. 5,829,213 mentioned above. However, it is preferable that the expanded portion 28 be designed so as to mirror a ball shape at the upper end of the stem portion 30, with a diameter larger than the cross-section dimension of the stem portion 30. This will still maintain a general T-shape as illustrated in the above mentioned patent but the ball-shaped upper portion of the stem 30, which is still within the scope of the claims of the above mentioned patent, will provide for additional concrete contact surface to the slab saver 10.

The stem portion 30 with upper portion 28 forms a "KEY" in the concrete wall 12 which is used to secure the slab saver 10 firmly in place within the bottom outside corner 14 of the wall 12. The sides 22 and 24 of longitudinally extending member 20 will thus form the bottom outside corner 14 of the wall 12.

Figure 4:
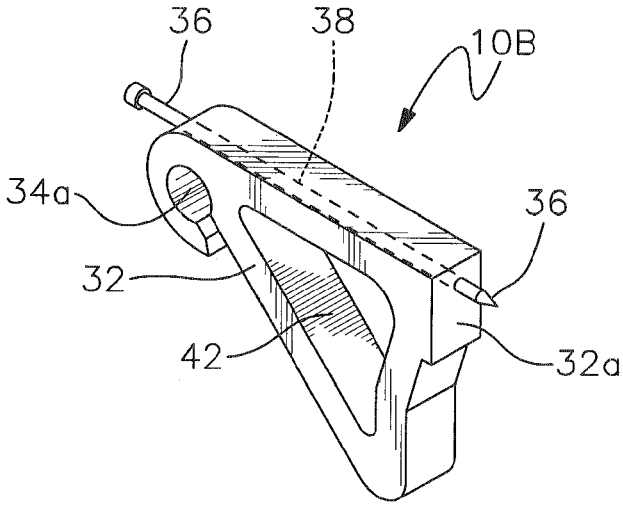
FIG. 4 is a conceptual representation of another embodiment of the inventive slab saver attachment device.
Figure 2:
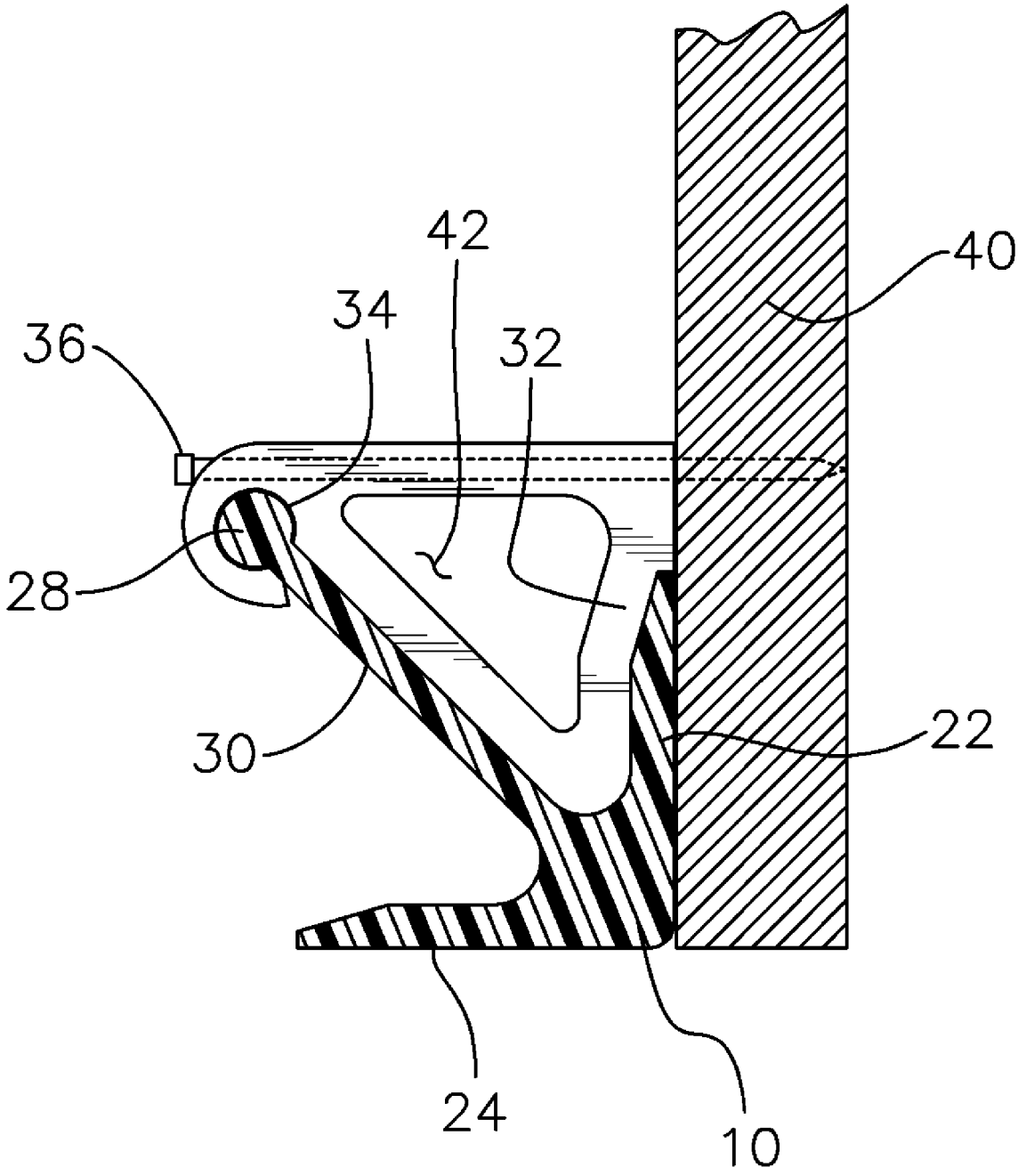
FIG. 2 is a cross-sectional view of the device of FIG. 1 illustrating another example of the attachment device being nailed into a form board after engaged with the stem portion of the slab saver.

The invention includes means for attaching the slab saver corner piece 10 to a form board 40 used to pour concrete to form a wall slab 12, as shown in FIGS. 1, 2 and 4. Preferably, this is a form attachment device 10A or alternative embodiment 10B, which has a generally shaped triangular form 32 configured to be inserted between one side 22 of the slab saver corner piece 10 and the stem portion 30 of said slab saver corner piece 10. Attachment device 10A or 10B includes at its corner, means for engaging the expanded portion 28 of the stem portion 30 of the slab saver corner piece 10. Preferably, the means for engaging the expanded portion 28 of the stem portion 30 of the slab saver corner piece 10 is a generally C-shaped slotted portion 34 forming a slotted aperture 34*a* configured to engage the expanded portion 28 of the stem portion 30. In a preferred embodiment, the formed slotted aperture 34*a* is a circular aperture configured to engage a generally circular shaped expanded portion 28 of the stem portion 30.

The attachment device 10A or 10B further includes a longitudinal aperture 38 near an upper edge of the form attachment device 10A or 10B. This aperture 38 extends from near the means for engaging the expanded portion 28 of the stem portion 30 of the slab save corner piece 10 through an adjacent side 32*a* of the generally shaped triangular form 32. As mentioned above, a preferred embodiment includes a hollowed portion or aperture 42 in the core area of the generally shaped triangular form 32, depicted as 10B embodiment. The longitudinal aperture 38 is sized to insert a nail 36 for engaging the combined slab saver corner piece 10 and form attachment device 10A or 10B to the form board 40.

The slab saver corner piece 10 is typically made from material that includes, but is not limited to, a synthetic resin material or a polypropylene material formulated to be softer than the concrete floor 18 over which the wall 12 is dragged. Material to form the attachment device need not be made from material softer than the concrete floor as described below.

The form attachment device 10A or 10B is typically made from material that includes, but is not limited to, a synthetic resin material, a polypropylene material, a nylon material, a composite of a polymeric material or combinations of these materials, metal, iron, aluminum, etc., as all of it is embedded in the concrete and not exposed.

The typical thickness or width of the attachment device is about ¼ inch to ½ inch depending on the material and nail size used. The size of the corner piece 10 is typically about 1.25 to 1.625 inches on the side with a stem portion 30 extending about 2.20 to 2.5 inches in length. The attachment device 10A or 10B is sized and configured to mate with the appropriate corresponding corner piece 10.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A concrete poured wall corner slab saver and form attachment device comprising:

a slab saver corner piece having a predetermined length and a first side and a second side, each side being generally perpendicular to each other with an inwardly directed central stem portion, the stem portion having an expanded portion at its distal end;

means for attaching said slab saver corner piece to a form board used to pour concrete to form a wall slab, said means for attaching the slab saver corner piece being a form attachment device having a generally shaped triangular form configured to be inserted between one side of said slab saver corner piece and the stem portion of said slab saver corner piece, so that one side of said generally shaped triangular form is configured to be generally in contact with said one side of said slab saver corner piece and another side of said generally shaped triangular form is configured to be generally in contact with said stem portion;

said form attachment device further comprising near a corner of said generally shaped triangular form, means for engaging the expanded portion of the stem portion of the slab saver corner piece; and a longitudinal aperture running a substantial length of said form attachment device near an upper edge of said form attachment device, said aperture extending from near said means for engaging the expanded portion of the stem portion of the slab saver corner piece through an adjacent side of said generally shaped triangular form, said longitudinal aperture being configured and sized to insert a generally headless nail for engaging the combined slab saver corner piece and form attachment device to said form board and further configured so that said nail exits said longitudinal aperture above one of said sides of said slab saver corner piece for direct nailing into said form board.

2. The concrete poured wall corner slab saver and form attachment device according to claim 1, wherein said means for engaging the expanded portion of the stem portion of the slab saver corner piece is a generally C-shaped slotted portion forming a slotted aperture configured to engage the expanded portion of the stem portion.

3. The concrete poured wall corner slab saver and form attachment device according to claim 2, wherein said formed slotted aperture is a circular aperture configured to engage a generally circular shaped expanded portion of the stem portion.

4. The concrete poured wall corner slab saver and form attachment device according to claim 1, wherein said slab saver corner piece is made from material selected from the group consisting of a synthetic resin material or polypropylene material formulated to be softer than a concrete floor over which the wall is dragged.

5. The concrete poured wall corner slab saver and form attachment device according to claim 1, wherein said form attachment device is made from material selected from the group consisting of a synthetic resin material, polypropylene material, nylon material, a composite of a polymeric material metal, iron and aluminum.

6. The concrete poured wall corner slab saver and form attachment device according to claim 1, wherein said attachment device further comprises a hollowed core portion.

* * * * *